US010100541B1

(12) United States Patent
Widjaja

(10) Patent No.: US 10,100,541 B1
(45) Date of Patent: Oct. 16, 2018

(54) PRECAST LIGHTWEIGHT WALL PANEL INSTALLATION MACHINE

(71) Applicant: JOE GREEN PTE. LTD., Singapore (SG)

(72) Inventor: Boediman Widjaja, Singapore (SG)

(73) Assignee: JOE GREEN PTE. LTD., Singapore (SG)

( * ) Notice: Subject to any disclaimer, the term of this patent is extended or adjusted under 35 U.S.C. 154(b) by 0 days.

(21) Appl. No.: 15/475,106

(22) Filed: Mar. 30, 2017

(51) Int. Cl.

| | |
|---|---|
| ***E04G 21/14*** | (2006.01) |
| ***E04G 21/16*** | (2006.01) |
| ***E04F 21/00*** | (2006.01) |
| ***E04F 21/18*** | (2006.01) |

(52) U.S. Cl.
CPC ..... *E04G 21/168* (2013.01); *E04F 21/0023* (2013.01); *E04F 21/1811* (2013.01)

(58) Field of Classification Search
CPC . B62B 3/108; B62B 2203/10; B65G 2249/04; B65G 49/067; B65G 7/08; C03B 33/03; B21C 47/242; B23K 37/047; E04F 21/1894; E04F 21/1816; E04F 21/18; E04F 21/1838
USPC .... 269/905, 910; 414/10–12, 494, 743, 778; 52/745.11
See application file for complete search history.

(56) References Cited

U.S. PATENT DOCUMENTS 2,828,870 A * 4/1958 Corley ..... B66C 7/00 414/11
3,458,056 A * 7/1969 Harkins ..... B25B 11/00 269/55
3,458,057 A * 7/1969 Stefan ..... B25B 11/00 269/55
3,668,955 A * 6/1972 Rupprecht ..... C03B 33/027 225/96.5
3,790,003 A * 2/1974 Tausheck ..... B65G 49/067 414/494
3,881,618 A * 5/1975 Tausheck ..... B65G 49/067 414/494

(Continued)

FOREIGN PATENT DOCUMENTS

CN 102910555 A 2/2013
CN 105712105 A 6/2016

(Continued)

*Primary Examiner* — Gregory W Adams
(74) *Attorney, Agent, or Firm* — Maschoff Brennan

(57) ABSTRACT

A precast lightweight wall panel installation machine is capable for erection and installation of precast lightweight concrete wall panels. The machine includes a frame base holding the panel installation machine, a lifting frame for lifting the precast lightweight concrete wall panel for erection and installation and at least a side hydraulic jack for lifting and flipping the concrete wall panel from packing position onto cart. Safety catch fittings hold the concrete wall panel from slipping off. An electrically operated hydraulic power unit with operating switches provides automated hydraulic lift to the machine. Rear mounted wheels and front mounted casters ease movement of the panel installation machine from one location to another. A power source supplies energy to operate the machine. The machine further includes the lifting frame mounted with adjustable slots to slot in brackets for erection and installation of the concrete wall panel at higher level platform.

9 Claims, 7 Drawing Sheets

(56) References Cited

U.S. PATENT DOCUMENTS

Figure 3A:
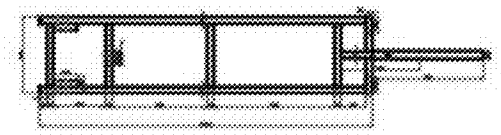

| | | | | | |
|---|---|---|---|---|---|
| 3,923,167 | A * | 12/1975 | Blankenbeckler | B25H 1/00 | 414/11 |
| 3,954,189 | A * | 5/1976 | Sherritt | B60P 3/00 | 414/11 |
| 3,977,534 | A * | 8/1976 | Blake | E04F 21/1894 | 156/60 |
| 4,555,890 | A * | 12/1985 | Gartner | E04L 31/35 | 52/745.11 |
| 4,815,395 | A * | 3/1989 | Trueg | B65G 49/062 | 108/115 |
| 5,664,933 | A * | 9/1997 | Scherer | B60G 9/02 | 414/728 |
| 7,014,413 | B2 * | 3/2006 | Young | B62B 3/108 | 269/905 |
| 7,025,053 | B1 * | 4/2006 | Altamirano | B23D 47/025 | 125/13.01 |
| 8,348,287 | B1 * | 1/2013 | Smith | B62B 3/04 | 280/47.34 |
| 9,381,930 | B2 * | 7/2016 | Septimio | B62B 3/02 | |
| 2006/0120830 | A1 * | 6/2006 | Stewart | E04F 21/1811 | 414/10 |
| 2011/0280699 | A1 | 11/2011 | Zimmermann et al. | | |

FOREIGN PATENT DOCUMENTS

| | | | |
|---|---|---|---|
| JP | 3202260 | B2 | 8/2001 |
| WO | 2010/031511 | A1 | 3/2010 |

* cited by examiner

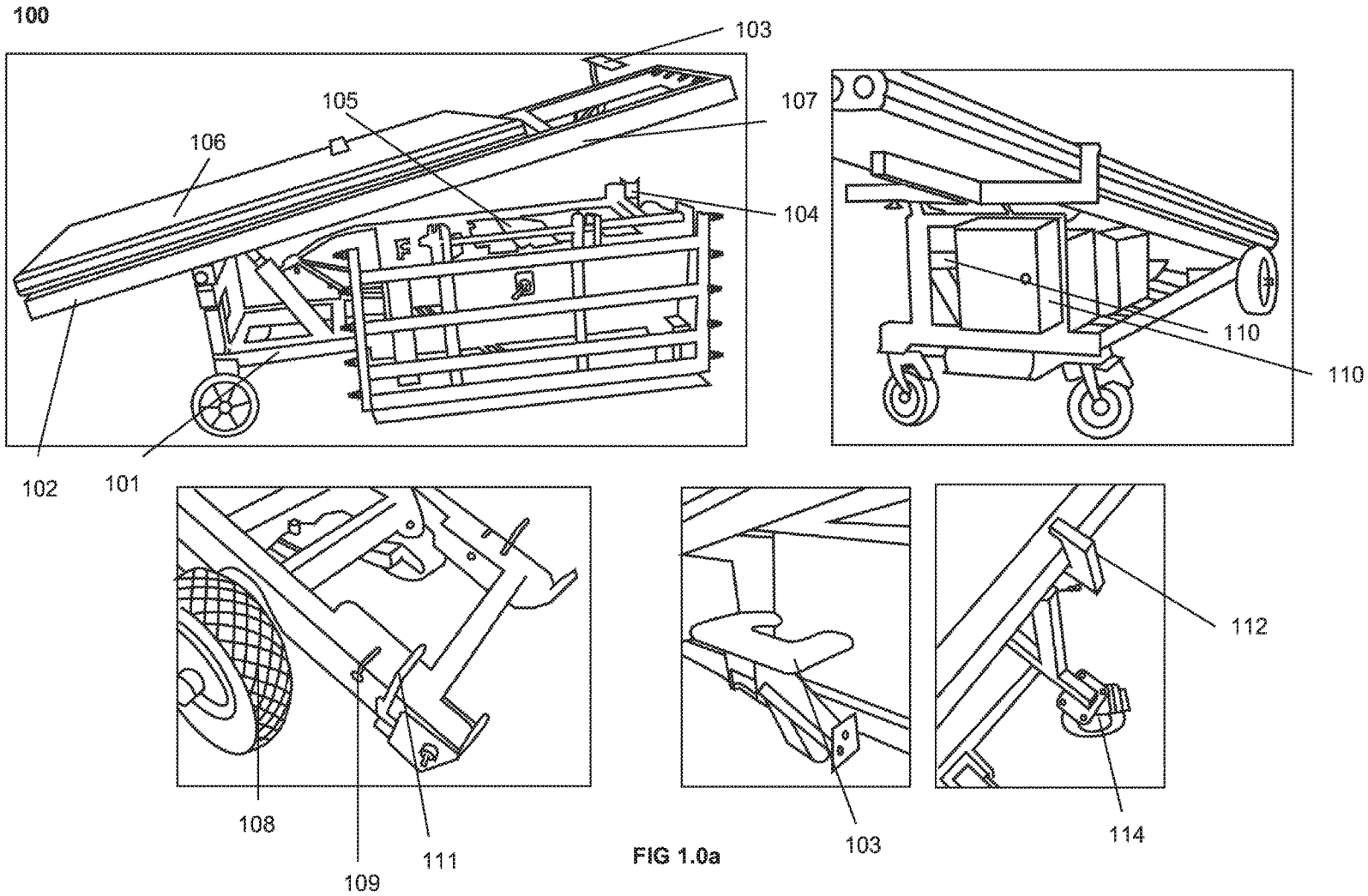
FIG 1.0a

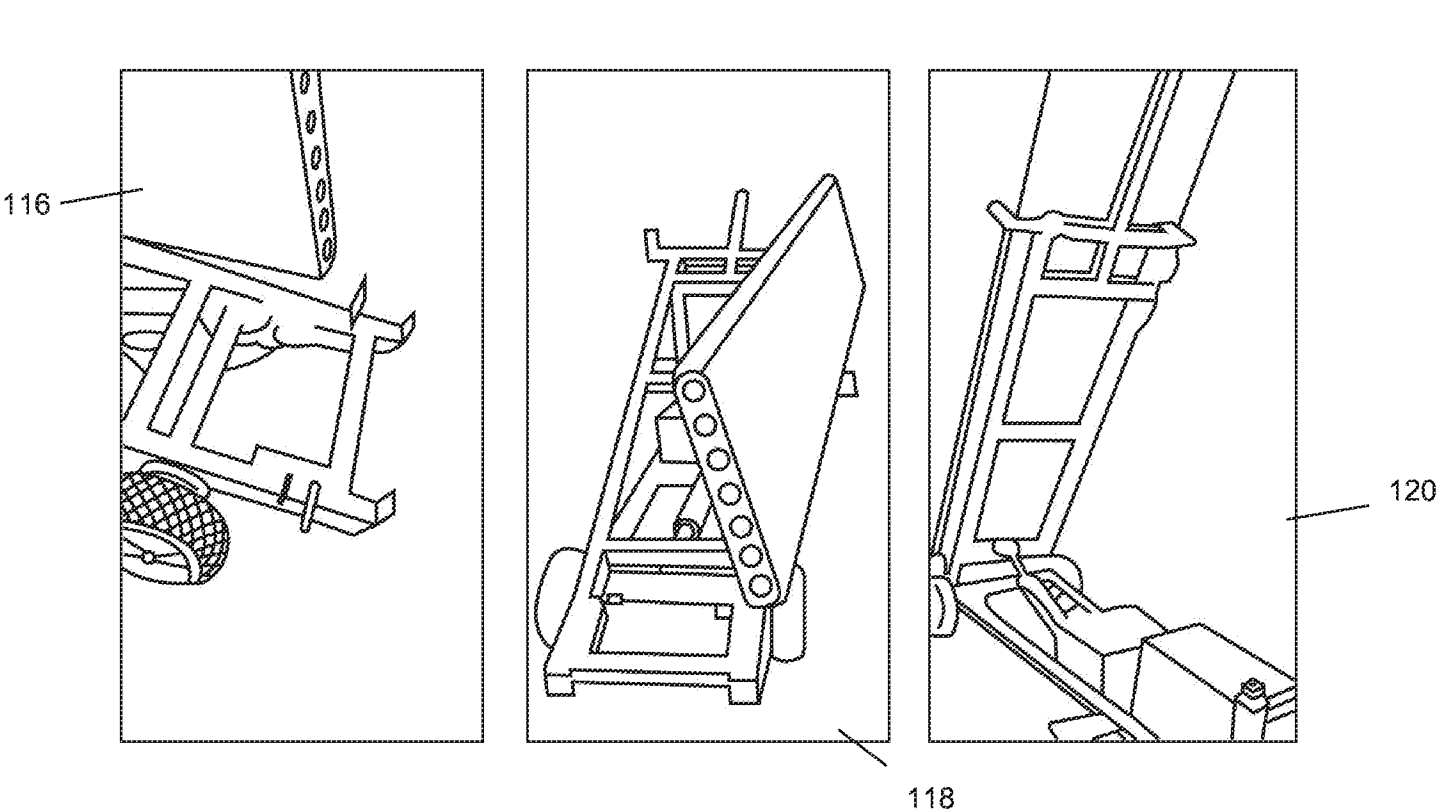
FIG. 1.0b

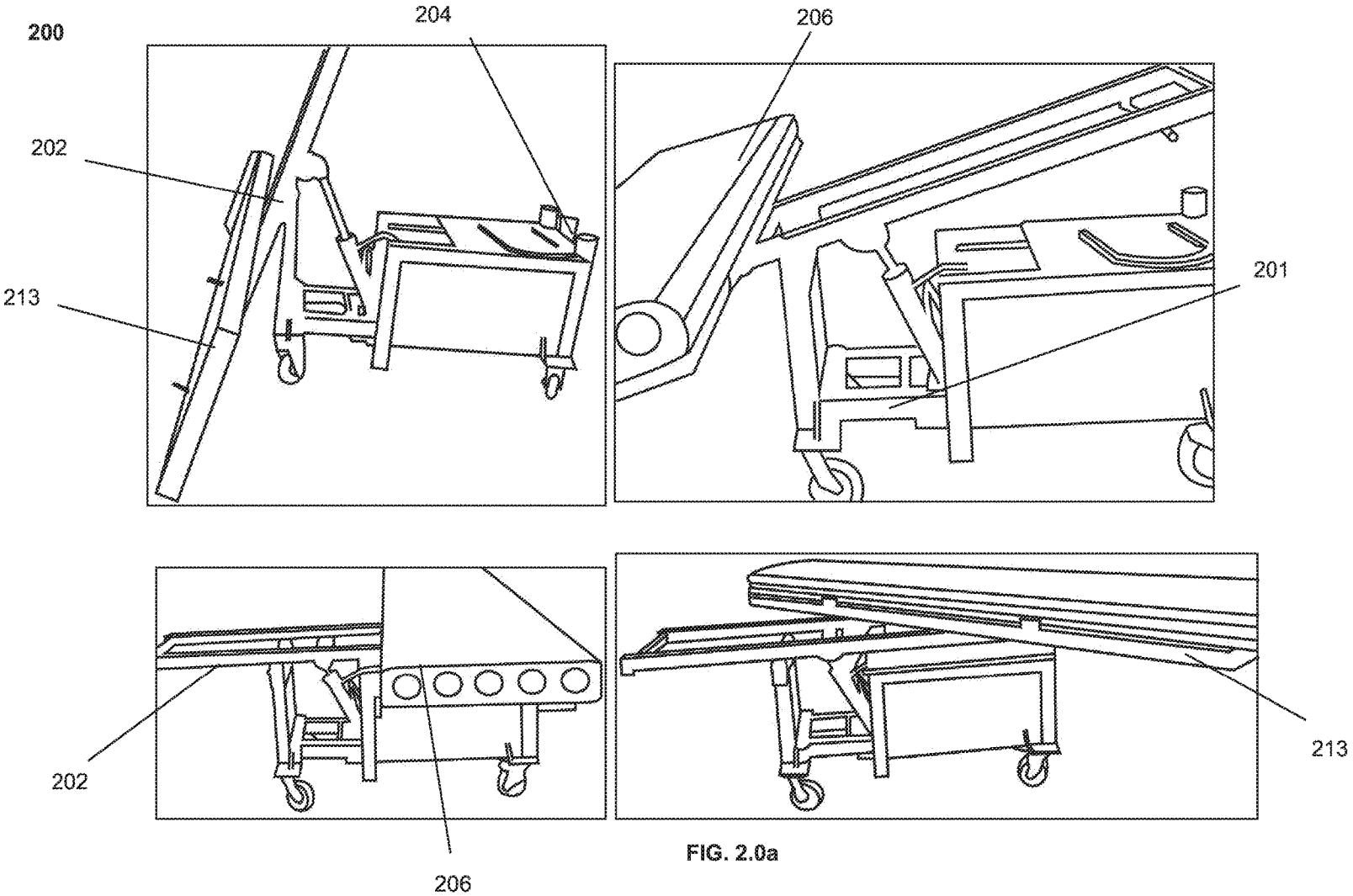
FIG. 2.0a

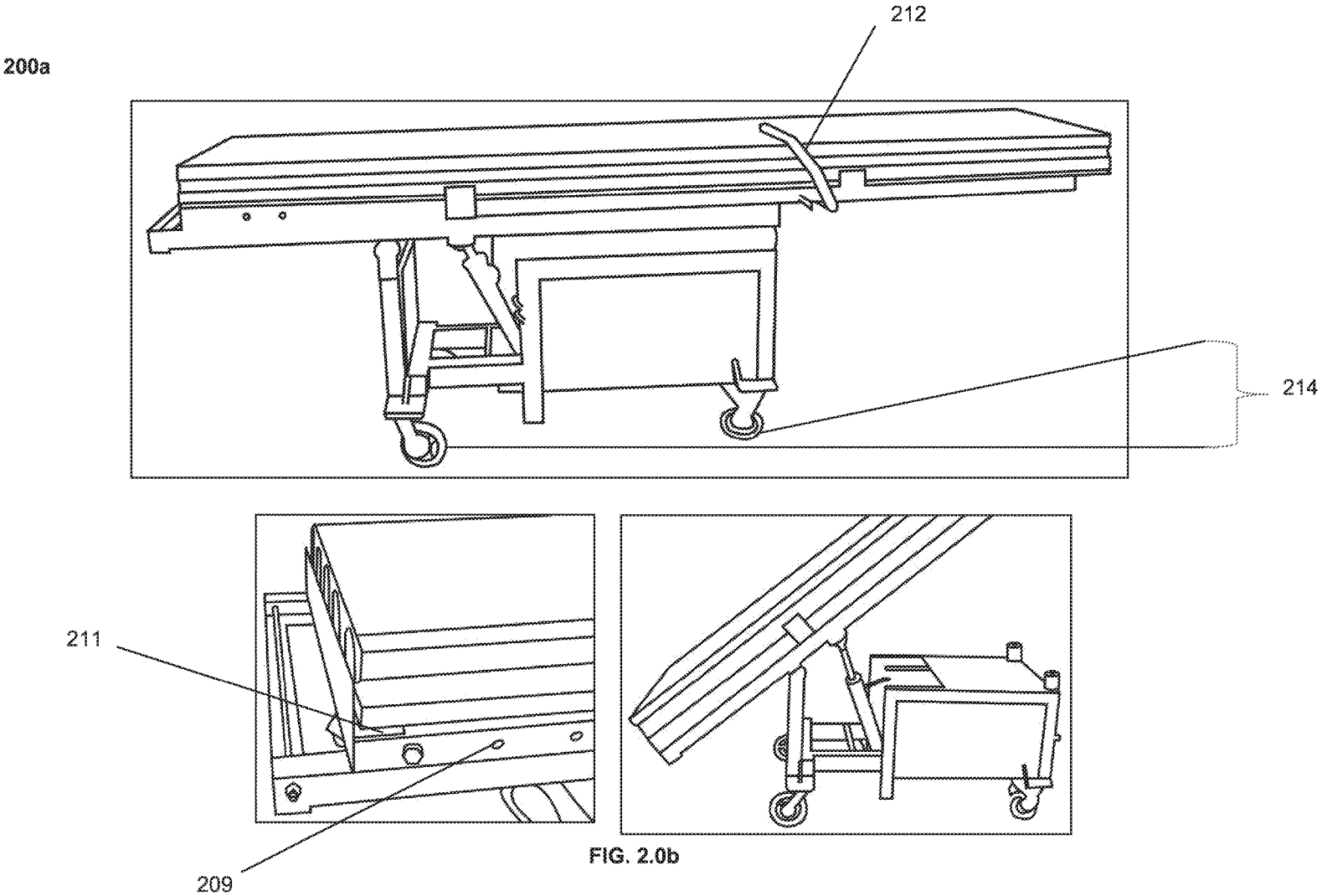
FIG. 2.0b

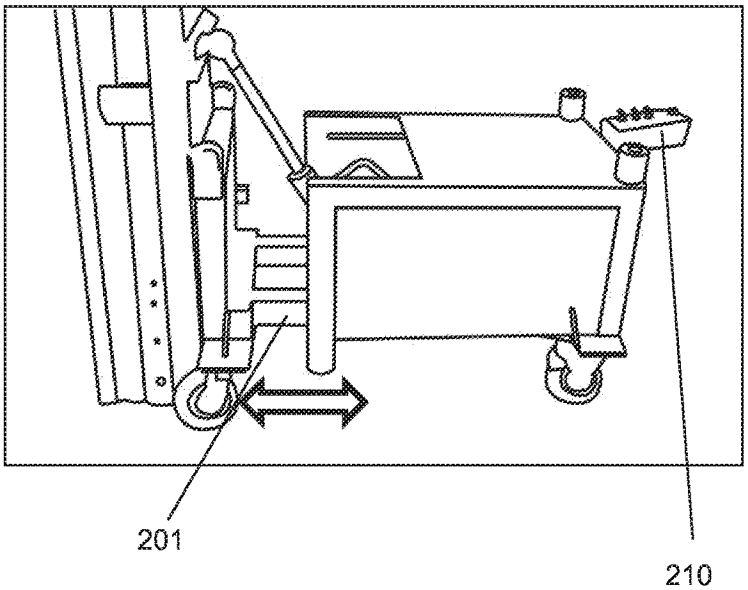
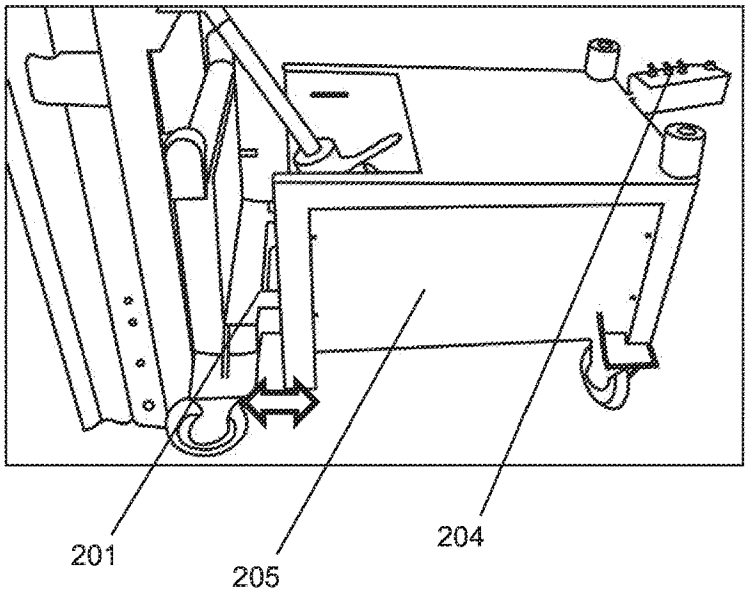
200b
FIG. 2.0c

300

400

PRECAST LIGHTWEIGHT WALL PANEL INSTALLATION MACHINE

FIELD OF INVENTION

The present invention relates to a precast lightweight wall panel installation machine for erection and installation of precast lightweight concrete wall panel. In particular, the machine is capable for erection and installation of the precast lightweight concrete wall panel by utilizing frame base mounted with adjustable slots.

BACKGROUND ART

In the construction industry, erection and installation of lightweight concrete wall panel is labor extensive, require physical strength of workers and involves high risk of injuries resulted from manual installation by the workers. Moreover, manual installation provides only 16 $m^2$/manday which are less productive and involves high cost of installation. Rough handling and stress lifting of the concrete wall panel may damage the concrete wall panel as the workers are required to use physical strength to lift the concrete wall panel. Further, injury risk exposure is increased due to the condition of the workers being fatigue during the installation operation.

Currently, the existing lifting device being utilize for the installation of wall panel which is known as "Flat Bed Frame Wall Panel Lifting Machine" has several drawbacks. The existing machine is limited for only handling certain load capacity and height of wall panel. Under certain circumstances, the machine requires more manpower to flip and lay the wall panel on the lifting frame. The machine is also unable of installing wall panel above kerbs and provides low towing handle that may cause obstruction and difficulty to operate in tight working space.

Another example of panel transport and erection machine for a panel such as a wall panel, a magnetic coil panel and the like which are erected along a track in the track for a linear motor car, an elevated tire running vehicle and the like is disclosed in Japanese Patent No. JP 3202260 B2 (JP 260 B2 Patent) entitled "Panel Transport and Erection Machine" having a filing date of 6 Jun. 1991 (Applicants: Tokai Ryokaku Tetsudo KK; Mitsubishi Heavy Ind Ltd; Central Japan Railway Co,; Mitsubishi Heavy Ind Ltd). In the JP 260 B2 Patent, the erection machine comprises a panel to be erected along a track which is mounted on a mobile trolley that is capable of mounting the panel. Further, in the JP 260 B2 Patent, the panel is lifted over to a specified position on the said track and the erection machine is further made up of a lifting beam which includes paired clamps which are detachably combined with a lifting lug section for the panel mounted on the mobile trolley. The JP 260 B2 Patent further disclose paired turning lift arms which rotatably support both end sections of the lifting beam located close to both ends of a trolley frame. A working space is needed for lifting out and erecting the panel as to make it compact in the invention disclosed in the JP 206 B2 Patent.

A further example for a lifting operation platform is disclosed in Chinese Patent Publication No. CN 102910555 A (CN 555 A Publication) entitled "Micro Travel Lifting Operation Platform" having a filing date of 9 Oct. 2012 (Applicant: Hubei Guorui Intelligent Equipment Co. Ltd). The CN 555 A Publication provides a micro travel lifting operation platform which comprises a base, an operation platform, an electric system and a lifting system. The lifting system supports the operation platform and comprises a cylinder with a lock, a guide mechanism and a plurality of groups of chain wheel lifting mechanisms driven by the cylinder. The chain wheel lifting mechanisms as disclosed in the CN 555 A Publication are electrically connected with one another through the electric system and matched with one another to be operated. The micro travel lifting operation platform provides that the internal force of the systems is only the dead weight of the operation platform and personnel. The operation platform proposed in the CN 555 A Publication also provides with a lifting in place detection switch to detect if the operation platform is lifted in place and the stability of the operation platform as well as the safety of operating personnel are guaranteed through a pneumatic mechanical self-locking cylinder.

Another mechanism that provides the loading and unloading platform is disclosed in Chinese Patent Publication No. CN 105712105 A (CN 105 A Publication) entitled "Internal Folding Type Loading and Unloading Platform" having a filing date of 14 Apr. 2016 (Applicant: Shanghai Bdh Logistic Facilities & Eng Co Ltd). The CN 105 A Publication proposed an internal folding type loading and unloading platform used for a cold-chain logistics warehouse or an iso-temperature warehouse. The internal folding type loading and unloading platform disclosed in the CN 105 A Publication can be disposed inside the cold-chain logistics warehouse or the iso-temperature warehouse. The internal folding type loading and unloading platform disclosed in the CN 105 A Publication is disposed on a mounting frame in a reserved foundation pit which is downward from a floor level and close to a doorway of the warehouse in the warehouse. The internal folding type loading and unloading platform comprises a main face plate, a butt strap, a platform surface assembly oil cylinder, a butt strap oil cylinder, a hydraulic power unit and an electrically operated control box. The main face plate and the butt strap are arranged approximately in parallel. The electrically operated control box sends an instruction to the hydraulic power unit so as to control the platform surface assembly oil cylinder and the butt strap oil cylinder to operate, and a loading and unloading platform surface is switched between an internally folded state and an extending state to adjust the lifting amplitude of the main face plate and the butt strap.

A further example which introduces lifting loading platform is disclosed in International Patent Publication No. WO 2010/031511 A1 (WO 2010/031511 A1 Publication) entitled "Lifting Loading Platform" having a filing date of 8 Sep. 2009 (Applicant: MBB Palfinger Gmbh). The WO 2010/031511 A1 Publication disclosed lifting loading platforms for trucks having a loading platform that can be lifted and lowered and pivoted by means of a lifting unit. The lifting unit of WO 2010/031511 A1 Publication comprises a hydraulic cylinder for the lifting and lowering and for the pivoting of the lifting loading platform whereby the operation of the hydraulic cylinder requires a hydraulic unit and relatively large hydraulic lines. The invention in the WO 2010/031511 A1 Publication further provides a lifting loading platform, whereby the loading platform is lifted, lowered, and pivoted by means of electric linear drives. The linear drives are equipped in a particular manner with a plurality of rod-shaped electric motors mutually driving a toothed gear. A spindle nut can be rotated on a threaded spindle by the toothed gear. In this manner the threaded spindle can be axially displaced in the manner of piston rods of hydraulic cylinders. Due to the electrically operated linear drives the lifting loading platform according to the invention requires no hydraulic unit, and therefore also no hydraulic lines.

Therefore, there is a need to build a machine with special features for lifting a concrete wall panel which enhances productivity and efficiency, safe and minimizes installation cost.

SUMMARY OF INVENTION

The present invention relates to a precast lightweight wall panel installation machine (100) for erection and installation of precast lightweight concrete wall panel (106). In particular, the machine (100) is capable for erection and installation of the precast lightweight concrete wall panel (106) by utilizing frame base (101) mounted with adjustable slots (109).

One aspect of the invention provides a precast lightweight wall panel installation machine (100) for erection and installation comprising a frame base (101) for holding the panel installation machine (100), a lifting frame (102) for lifting precast lightweight concrete wall panel (106) to a vertical position for erection and installation, at least a side hydraulic jack (103) for lifting and flipping the precast lightweight concrete wall panel (106) from packing position onto cart, at least a pair of safety catch fitting (112) for holding the precast lightweight concrete wall panel (106) from slipping off, an electrically operated hydraulic power unit (110) with operating switches (104) to provide automated hydraulic lift to said machine (100), a pair of rear mounted wheels (108) and a pair of front mounted casters (114) to ease movement of the machine (100) from one location to another and a power source (105) for supplying electric energy to operate the machine (100).

A further aspect of the invention provides that the frame base (101) is movable apart from a static position.

Still another aspect of the invention provides that the machine (100) further comprises the lifting frame (102) that is mounted with adjustable slots (109) to slot in brackets (111) for erection and installation of the precast lightweight concrete wall panel (106) at a higher platform level such as kerbs.

Another aspect of the invention provides that the lifting frame (102) further comprises of an extension supporter (107) for handling longer precast lightweight concrete wall panel (106).

Yet another aspect of the invention provides that the frame base (101) and the lifting frame (102) are preferably made of steel.

A further aspect of the invention provides that the side hydraulic jack (103) is disposed to receive the vertical stacked panel.

Still another aspect of the invention provides that the hydraulic jack (103) is retractable to reduce size of the machine (100).

Still another aspect of the invention provides that the electric hydraulic power unit (110) with operating switches (104) is operable wireless with remote control.

A preferred aspect of the invention provides that the pairs of wheel (108) are casters (114).

A further aspect of the invention provides that the higher level platform is within range of 0.1 m to 0.15 m onto the Reinforce Concrete (RC) kerbs.

The present invention includes features and a combination of parts hereinafter fully described and illustrated in the accompanying drawings, it being understood that various changes in the details may be made without departing from the scope of the invention or sacrificing any of the advantages of the present invention.

BRIEF DESCRIPTION OF ACCOMPANYING DRAWINGS

The patent or application file contains at least one drawing executed in color. Copies of this patent or patent application publication with color drawing(s) will be provided by the Office upon request and payment of the necessary fee.

To further clarify various aspects of some embodiments of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the accompanying drawings in which:

FIG. 1*a* illustrates the precast lightweight wall panel installation machine of the present invention.

FIG. 1*b* is an example of lifting up and flipping the precast lightweight concrete wall panel prior to erection and installation operation.

FIG. 2*a* illustrates another embodiment of the precast lightweight wall panel installation machine of the present invention.

FIG. 2*b* and FIG. 2*c* illustrate a further embodiment of the precast lightweight wall panel installation machine of the present invention.

FIG. 3*a* to FIG. 3*f* are diagrams illustrating different angles of the process of lifting the precast lightweight concrete wall panel for erection and installation.

Figure 4B:
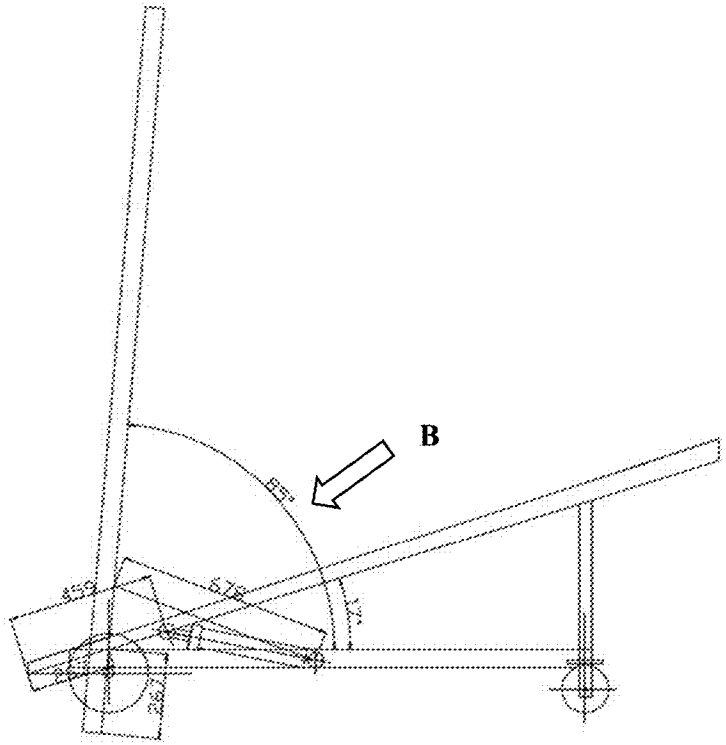
Figure 4A:
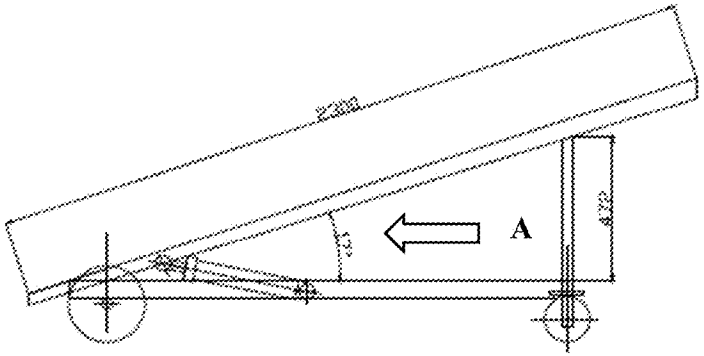

FIG. 4*a* and FIG. 4*b* are diagrams illustrating the inclination angles of the precast lightweight wall panel installation machine for erection and installation.

DETAILED DESCRIPTION OF THE PREFERRED EMBODIMENTS

The present invention relates to a precast lightweight wall panel installation machine (100) for erection and installation of precast lightweight concrete wall panel (106). In particular, the precast lightweight wall panel installation machine (100) is capable for erection and installation of the precast lightweight concrete wall panel (106) at high level platform by utilizing lifting frame (102) mounted with adjustable slots (109). Hereinafter, this specification will describe the present invention according to the preferred embodiments. It is to be understood that limiting the description to the preferred embodiments of the invention is merely to facilitate discussion of the present invention and it is envisioned without departing from the scope of the appended claims.

The present invention enhances the efficiency and increases the installation concrete wall coverage at a much lower cost as well as reducing damage to concrete wall panels due to rough handling and stress during the lifting operation without proper mechanical means and sufficient support. Further, the cost of installation is reduced as the productivity and efficiency is increased with reduction in the number of workers required from 4 workers to just 2 workers.

Reference is first made to FIG. 1*a* which illustrates the precast lightweight wall panel installation machine (100) of the present invention. As illustrated in FIG. 1*a*, the precast lightweight wall panel installation machine (100) is an inclined machine which comprises a frame base (101) for holding the precast lightweight wall panel installation machine (100), a lifting frame (102) for lifting the precast lightweight concrete wall panel (106) for erection and installation, at least a side hydraulic jack (103) for lifting and flipping the precast lightweight concrete wall panel (106) from packing position onto cart, a Direct Current (DC) electric hydraulic power unit (110) with operating switches (104) for providing automatic hydraulic lift to the precast lightweight wall panel installation machine (100), and at least a power source (105) for supplying energy to operate the machine.

The present invention provides a pair of wheels (108) and a pair of casters (114) mounted at the front end and at the rear end of the precast lightweight wall panel installation machine (100) to ease movement from one location to another, an extension supporter (107) for handling long precast lightweight concrete wall panel (106) and a pair of safety catch fitting (112) for holding the precast lightweight concrete wall panel (106) from slipping off. The pair of wheels (108) are alternatively casters (114).

The present invention further provides that the precast lightweight wall panel installation machine (100) is mounted with adjustable slots (109) to slot in brackets (111) for erection and installation of the precast lightweight concrete wall panel (106) at high level platform. The concrete wall panel (106) may be installed up to the above of RC kerbs, plinths or higher platform.

Reference is now made to FIG. 1*a* which is provides an example of lifting and flipping the precast lightweight concrete wall panel for erection and installation operation. As illustrated in FIG. 1*a*, the bottom end of the lightweight concrete wall panel (106) is positioned (116) on the lifting frame (102) on the right side and holds by the safety catch fitting (112) with the upper end being placed on the lifting frame (102) and further being held (118) by the safety catch fitting (112). Once the lightweight concrete wall panel (106) is laid horizontally on the lifting frame (102), the precast lightweight wall panel installation machine (100) lifts up (120) the lightweight concrete wall panel (106) to the desired installation area by switching the operating switch.

Reference is now made to FIG. 2*a* which illustrates another embodiment of the precast lightweight wall panel installation machine (200) of the present invention. As illustrated in FIG. 2*a*, the precast lightweight wall panel installation machine (200) is a retractable panel installation machine. The panel installation machine (200) of the present invention comprises of a frame base (201) for holding the precast lightweight wall panel installation machine (200), a lifting frame (202) for lifting the precast lightweight concrete wall panel (206) for erection and installation, and at least a swivel (213) for lifting and pivoting the precast lightweight concrete wall panel (206) from packing position onto the lifting frame (202).

Reference is now made to FIG. 2*b* in which the retractable precast lightweight wall panel installation machine (200) further comprises of at least a pair of casters (214) mounted at the front end and at the rear end of the precast lightweight wall panel installation machine (200) to ease movement from one location to another, at least a pair of safety catch fitting (212) for holding the precast lightweight concrete wall panel (206) from slipping off, the adjustable slots (209) to slot in brackets (211) for erection and installation of the precast lightweight concrete wall panel (106) at high level platform. The concrete wall panel (206) may be installed up to the above of RC kerbs, plinths or higher platform.

Reference is now made to FIG. 2*c* which further illustrates the retractable precast lightweight wall panel installation machine (200) comprising a Direct Current (DC) electric hydraulic power unit (210) with operating switches (204) for providing automatic hydraulic lift to the precast lightweight wall panel installation machine (200), and at least a power source (205) for supplying energy to operate the machine (200). The frame base (201) of the precast lightweight wall panel installation machine (200) is retractable which will reduce size of the said machine (200) to operate in a small working space. The precast lightweight wall panel installation machine (200) is operable equally in both retractable position and static position.

Figure 3B:
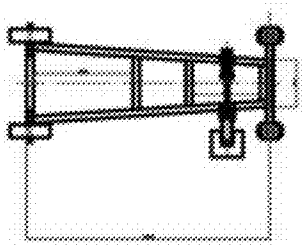
Figure 3C:
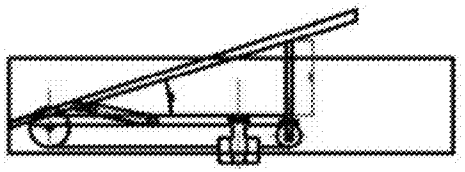

Reference is now made to FIG. 3*a* to FIG. 3*f* which are diagrams illustrating different angles of the process of lifting the precast lightweight concrete wall panel for erection and installation. FIG. 3*a* is an upper view of the lightweight concrete wall panel (106) positioned horizontally on the lifting frame (102) of the precast lightweight wall panel installation machine (100). FIG. 3*b* is the upper view of the lightweight concrete wall panel (106) positioned horizontally on the left side of the side hydraulic jack (103). FIG. 3*c* is the side view of the lightweight concrete wall panel (106) whereby it is flipped and positioned vertically on the left side of the side hydraulic jack (103).

Figure 3D:
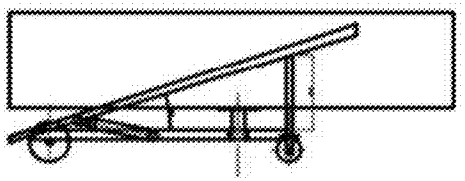
Figure 3E:
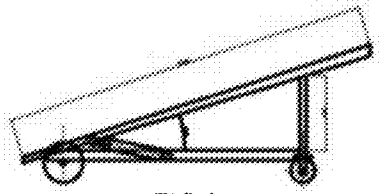
Figure 3F:
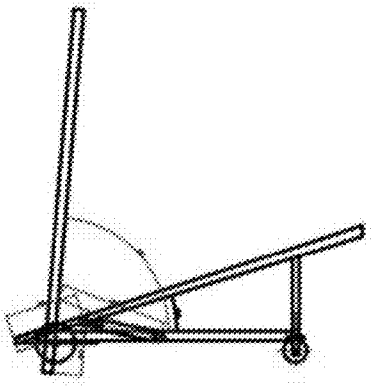

FIG. 3*d* is the side view of the lightweight concrete wall panel (106) whereby it is flipped and positioned vertically on the right side of the side hydraulic jack (103). FIG. 3*e* is the side view of the lightweight concrete wall panel (106) positioned on the lifting frame (102) of the precast lightweight wall panel installation machine (100) upon lifted up by certain angle. FIG. 3*f* is the side view of the lightweight concrete wall panel (106) positioned vertically at a certain angle whereby the said lightweight concrete wall panel (106) is held by safety catch fitting (112) mounted on bottom end of the lifting frame (102) of the precast lightweight wall panel installation machine (100).

Reference is now made to FIG. 4*a* and FIG. 4*b* which are diagrams illustrating inclination angles of the precast lightweight wall panel installation machine (100) for erection and installation. As indicated by arrow A, the lifting frame (102) of the inclined precast lightweight wall panel installation machine (210) is preferably positioned at least 17° to hold the precast lightweight concrete wall panel (106) in a stable condition prior to be lifted up for erection and installation. As indicated by arrow B, preferably at least 85° is required by the lifting frame (102) to lift up the precast lightweight concrete wall panel (106) for erection and installation.

The present invention provides for precast lightweight wall panel installation machine (100) for erection and installation of precast lightweight concrete wall panel (106) at higher level onto the RC kerbs by utilizing lifting frame (102) mounted with adjustable slots (109) in brackets. Further, the present invention provides a safe working operation whereby safety catch fitting (112) are mounted on both sides of the lifting frame as well as its suitability for handling a standard capacity load of concrete wall panel (106) up to a preferred height of 3.6 meters.

Unless the context requires otherwise or specifically stated to the contrary, integers, steps or elements of the invention recited herein as singular integers, steps or elements clearly encompass both singular and plural forms of the recited integers, steps or elements.

Throughout this specification, unless the context requires otherwise, the word "comprise", or variations such as "comprises" or "comprising", will be understood to imply the inclusion of a stated step or element or integer or group of steps or elements or integers, but not the exclusion of any other step or element or integer or group of steps, elements or integers. Thus, in the context of this specification, the term "comprising" is used in an inclusive sense and thus should be understood as meaning "including principally, but not necessarily solely".

The invention claimed is:

1. A precast lightweight wall panel installation machine for erection and installation comprising:

a frame base for holding the panel installation machine;

a lifting frame for lifting precast lightweight concrete wall panel to a vertical position for erection and installation, the lifting frame mounted with adjustable slots to slot in brackets for erection and installation of the precast lightweight concrete panel wall at a higher level platform, preferably kerbs;

at least a side hydraulic jack for lifting and flipping the precast lightweight concrete wall panel from packing position onto cart;

at least a pair of safety catch fitting for holding the precast lightweight concrete wall panel from slipping off;

an electrically operated hydraulic power unit with operating switches to provide automated hydraulic lift to said machine;

a pair of rear mounted wheels and a pair of front mounted casters to ease movement of the machine from one location to another; and a power source for supplying electric energy to operate the machine.

2. The machine according to claim 1, wherein the frame base is movable apart from a static position.

3. The machine according to claim 1, wherein the lifting frame further comprises an extension supporter for handling longer precast lightweight concrete wall panel.

4. The machine according to claim 1, wherein the frame base and the lifting frame are formed from steel.

5. The machine according to claim 1, wherein the side hydraulic jack is disposed to receive the vertical stacked panel.

6. The machine according to claim 1, wherein the hydraulic jack is retractable to reduce size of the panel installation machine.

7. A precast lightweight wall panel installation machine for erection and installation comprising:

a frame base for holding the panel installation machine;

a lifting frame for lifting precast lightweight concrete wall panel to a vertical position for erection and installation;

at least a side hydraulic jack for lifting and flipping the precast lightweight concrete wall panel from packing position onto cart;

at least a pair of safety catch fitting for holding the precast lightweight concrete wall panel from slipping off;

an electrically operated hydraulic power unit with operating switches to provide automated hydraulic lift to said machine, the hydraulic power unit operable wirelessly with a remote control;

a pair of rear mounted wheels and a pair of front mounted casters to ease movement of the machine from one location to another; and a power source for supplying electric energy to operate the machine.

8. The machine according to claim 1, wherein the pairs of wheels are casters.

9. The machine according to claim 1 wherein the higher level platform is within range of 0.1 meters to 0.15 meters onto the Reinforce Concrete, RC kerbs.

* * * * *